United States Patent [19]

Quarles

[11] Patent Number: 4,510,761

[45] Date of Patent: Apr. 16, 1985

[54] ICE MAKING MACHINE WITH REVERSE DIRECTION HOT GAS THAWING AND PRESSURIZED GAS DISCHARGE

[76] Inventor: James H. Quarles, 818 Woodmore La., Chattanooga, Tenn. 37411

[21] Appl. No.: 484,347

[22] Filed: Apr. 12, 1983

Related U.S. Application Data

[63] Continuation-in-part of Ser. No. 379,830, May 19, 1982, Pat. No. 4,455,843, which is a continuation-in-part of Ser. No. 236,432, Jun. 21, 1981, abandoned.

[51] Int. Cl.[3] ..... F25C 5/10

[52] U.S. Cl. ..... 62/73; 62/278; 62/352; 417/118

[58] Field of Search ..... 62/352, 324.3, 278, 62/73; 417/118, 392; 134/166 C

[56] References Cited

U.S. PATENT DOCUMENTS

| | | | |
|---|---|---|---|
| 2,133,521 | 10/1938 | Wussow et al. | 62/352 X |
| 2,921,443 | 1/1960 | Lee | 62/352 X |
| 3,164,968 | 1/1965 | Mullins, Jr. | 62/73 |
| 3,774,406 | 11/1973 | Reitblatt | 62/278 X |
| 3,825,443 | 7/1974 | Reilly | 134/166 C X |
| 3,877,242 | 4/1975 | Creager | 62/352 X |
| 3,988,903 | 11/1960 | Brewer et al. | 62/352 X |
| 4,075,863 | 2/1978 | Wilson | 62/138 |

*Primary Examiner*—William E. Tapolcai

*Attorney, Agent, or Firm*—Griffin, Branigan & Butler

[57] ABSTRACT

An ice making machine selectively produces both white and clear ice. Water is frozen in a tube 14 which has disposed thereabout in heat exchange relation a refrigerant evaporator tube 92. During a freezing cycle a reversing valve 84 directs cold refrigerant through the evaporator tube 92 in a first direction FC. During a harvest cycle the reversing valve 84 directs hot refrigerant through the evaporator in a reverse direction HC. After thawing ice is discharged from the tube 14 by pressurized gas.

24 Claims, 4 Drawing Figures

RV
RAS
PM
PS
WV
WF
AF
AV
EI.
FC
HC

ICE MAKING MACHINE WITH REVERSE DIRECTION HOT GAS THAWING AND PRESSURIZED GAS DISCHARGE

BACKGROUND OF THE INVENTION

This application is a continuation-in-part of U.S. patent application Ser. No. 06/379,830, filed May 19, 1982, now U.S. Pat. No. 4,455,843, which was a continuation-in-part of U.S. patent application Ser. No. 06/236,432 filed June 21, 1981, now abandoned.

This invention pertains to ice-making machines and ice transport systems.

Many types of commercial establishments need ice making machines capable of producing large quantities of ice. Examples of such establishments include hotels, motels, restaurants, dairies, fish markets, and poultry processing plants. The large ice making machines utilized in these establishments must operate economically and require minimum maintenance.

In a typical ice making machine, a core of ice is formed in an inner tube of a tube-in-tube evaporator. Water flows through the inner tube during a freezing cycle while cold refrigerant is evaporated in an outer tube. During a harvest cycle, hot refrigerant flows through the outer tube to initiate thawing to loosen the ice in the tube so that the ice can be discharged. Upon discharge the ice is broken into pellets.

Unfortunately, ice making machines of the prior art inefficiently transport ice pellets to storage receptacles. In this regard, most prior art ice machines rely on cube-against-cube pressure to move ice through a transport system. As result, the ice moves rather slowly at a fairly uniform speed and some melting occurs.

At times commercial establishments need hard "clear" ice pellets which are long lasting and are characterized by a hollow aperture extending therethrough. At other times however, shorter-lived semi-hard "white" ice is preferable, such as in transporting goods for short distances in a brief period of time. Further, white ice may be produced more quantitatively and more economically per period of time than clear ice. Known prior art ice making machines either produce one type of ice or the other, but not both.

Conventional ice making machines utilize refrigeration circuits wherein, once a harvest cycle is initiated, a sufficient time must elapse in order for a compressor to compress enough hot gas to be used in the thawing operation. In some machines the elapsed time is on the order of 30 seconds or more, thus requiring considerable time between refrigeration cycles and hence a lower volume of ice production per unit of time.

In view of the foregoing problems and disadvantages associated with prior art ice making machines, an object of this invention is the provision of an ice making machine capable of producing both clear (hard) ice pellets and white (semi-hard) ice pellets within the same system.

The invention also advantageously discharges ice pellets at a high speed from the ice machine so that the ice pellets move more quickly, with less melting, and can be transported for greater distances. Consequently, floor space may be more advantageously utilized since the ice making machine can be remotely positioned from an ice collecting receptacle.

A further advantage of the invention is the provision of an ice making machine wherein the harvest cycle may be initiated essentially immediately without the time-consuming delay usually required for a compressor to compress enough hot gas to sufficiently thaw and loosen the ice for discharge.

SUMMARY OF INVENTION

An ice making machine is operable in either of two modes to produce white ice or clear ice. Valve means selectively communicate a tube wherein ice is formed with the remainder of a water circuit so that clear ice is formed when water is circulated through the tube but solid ice is formed when water is not circulated. The ice is formed as a result of heat exchange between water in the tube and a cold refrigerant which is circulated about the tube in a direction from the tube inlet to the tube outlet. Once it has been determined that the ice is sufficiently formed in the tube, a thawing operation commences wherein hot refrigerant is supplied in a second direction opposite the first direction to sufficiently loosen ice in the tube so that the ice may be discharged. The ice is discharged by a stream of pressurized gas which drives the loosened ice from the tube.

In a mode wherein white ice is formed in the ice making machine, water flows via gravity from a reservoir into the ice making tube where the water does not circulate. The water is frozen by heat exchange between the water and the refrigerant; thawed slightly to be sufficiently loosened in the tube; and, discharged from the tube by the application of pressurized gas.

In the mode wherein clear ice is formed in the ice making machine, water is introduced into the ice making tube at a point intermediate a first segment and a second segment of the tube. The first tube segment is so positioned that clear ice is formed therein as a pump circulates water through the tube and the water circuit. Water in the second tube segment remains static and is not circulated so that at least a plug of solid ice is formed in the second tube segment. Since in the thawing operation the hot refrigerant travels from the outlet of the tube to its inlet, the ice formed nearest the tube inlet has melted the least and has the smallest angular gap between the ice and the tube.

Pressurized gas is applied aproximate the second tube section for driving the plug of solid ice against the clear, hollow ice formed in the first tube segment and for discharging the ice from the tube. In this respect, there is minimum gas leakage about the plug of solid ice since, unlike the clear ice, it is not hollow and since it has the smallest annular gap between the ice and the tube. The smallest annular gap which occurs between the second tube segment and the plug of solid ice formed therein results from the fact that the second tube segment is the furtherest from the point of application of the hot refrigerant to the tube. Further, thermal conduction delay means comprising a sleeve member positioned intermediate the second tube segment and the refrigerant circuit retards conduction of thawing heat from the hot refrigerant to the plug of solid ice.

The ice making machine utilizes a reversing valve wherein, as noted above, cold refrigerant is circulated in a freezing cycle in a first direction from the tube inlet to the tube outlet but wherein hot refrigerant in a harvest cycle is circulated in a second direction opposite the first direction. The reversing valve employed in the refrigeration circuit allows the ice making machine to immediately switch into the harvest cycle by applying the hot compressed refrigerant already in the condensor to the refrigeration circuit for thawing ice in the tube.

Advantageously, there is no delay in waiting for the compressor to compress enough hot refrigerant.

BRIEF DESCRIPTION OF THE DRAWINGS

The foregoing and other objects, features, and advantages of the invention will be apparent from the following more particular description of preferred embodiments as illustrated in the accompaning drawings in which reference characters refer to the same parts throughout the various views. The drawings are not necessarily to scale, emphasis instead being placed upon illustrating the principles of the invention.

DETAILED DESCRIPTION OF THE DRAWINGS

Figures 1, 1A, 1B:
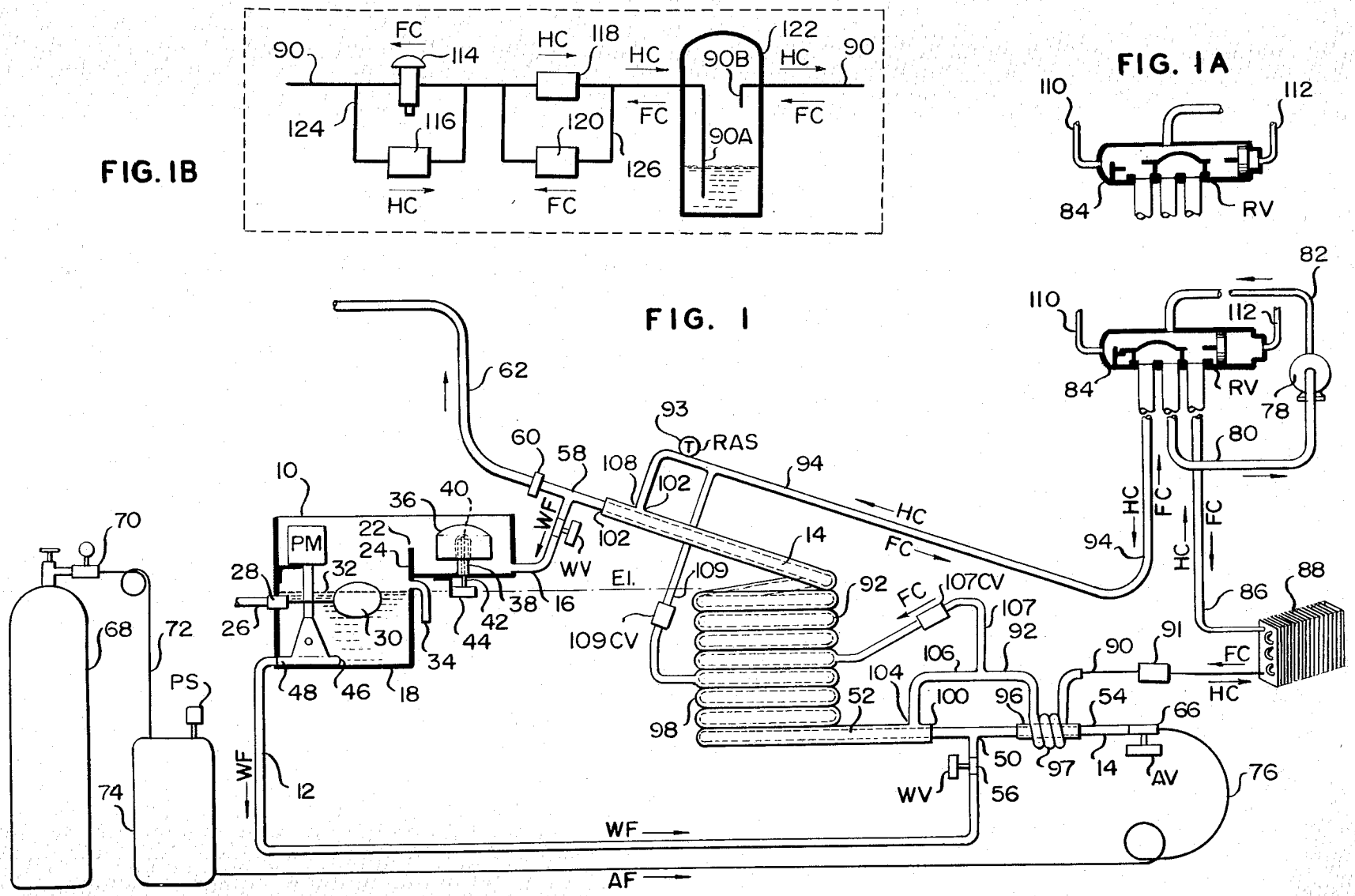
FIG. 1 is a schematic view illustrating an ice making machine system according to an embodiment of the invention.
FIG. 1A is a schematic view of a reversing valve of the embodiment of FIG. 1 showing the internal operation of the reversing valve during a harvest cycle.
FIG. 1B is a schematic view of a valve and tank network of the embodiment of FIG. 1; and, FIG. 2 is a circuit diagram showing the electrical connections of various components of the embodiment of FIG. 1.

The ice making machine system of FIG. 1 includes both a water circuit and a refrigeration circuit. The water circuit comprises a reservoir 10; a first water conduit 12; a tube 14 wherein ice is formed; and, a second conduit 16.

The reservoir 10 is a double reservoir comprising a first reservoir 18 and a second reservoir 20. The first reservoir 18 receives a discharge of water from the second reservoir 20. In this respect, an overflow dam 22 separates the reservoirs 18 and 20 such that water spills over dam 22 when the depth of reservoir 20 as determined by the height of dam 22 is insufficient to contain the water directed therein through conduit 16. Reservoir 20 communicates with reservoir 18 through a restrictor or orifice 24 through which water bleeds at a selectively variable rate.

Reservoir 18 is connected to a suitable source of water (not illustrated) through a water supply conduit 26. Conduit 26 selectively communicates with the reservoir 18 through a float-controlled valve 28. In this respect, float 30 maintains a water level 32 in the reservoir 18. An overflow pipe 34 is provided just above the water level 32.

A float 36 is located in a stand pipe 38 formed in the base of reservoir 20. Float 36 has a central cavity 40 therein so that the float 36 may travel vertically on the stand pipe 38. A central contact appendage 42 extends downwardly from the float cavity 40 through the stand pipe 38 in selective contact with a microswitch 44 positioned beneath the floor of the reservoir 20.

A low volume, low head pressure centrifugal water pump 46 is provided in the reservoir 18. Pump 46, driven by an electric motor PM, is adapted to pump water through a restrictor 48 and into the water conduit 12.

Water conduit 12 communicates with tube 14 at a point 50 which is intermediate a first tube segment 52 and a second tube segment 54. As shown in FIG. 1, conduit 12 intersects the tube 14 in T-shaped fashion with tube segment 52 being to the left of the intersection and tube segment 54 being to the right of the point of intersection 50. A water valve 56 (also labeled "WV") selectively controls the communication of water between conduit 12 and tube 14 near point 50.

From the intersection point 50 the tube segment 52 travels in a helical path climbing vertically through a plurality of turns until it makes an oblique departure, at the departure climbing essentially tangentially away from the center of the helix. The tube 14 terminates at a region 58 proximate the intersection of the tube 14 with the conduit 16. Conduit 16, which intersects with tube 14 in the region 58 as described above, contains a water valve 64 for selectively communicating the tube 14 with the conduit 16 (and hence the reservoir 10 wherein conduit 16 empties).

The outlet of the tube 14 is connected by a coupling 60 to flexible braided nylon tubing 62. Transport tube 62 is preferably enclosed in a rigid plastic or metal conduit having diameter larger than the diameter of the tube 14.

The second tube segment 54 is essentially linear and has an air valve 66 (also labeled "AV") positioned thereon at its rightmost extremity. The air valve 66 is adapted to selectively communicate the tube 14 with a pressurized gas discharge system. In this respect, the pressurized gas discharge system comprises a storage tank 68 (filled with $CO_2$ or air, exceeding 38 psi); a pressure reducing valve 70 (set at approximately 38 psi); a first capillary tube 72; a holding tank 74; and, a second capillary tube 76. The capillary tube 72 functions as a time delay to a pressurized holding tank 74. In one embodiment, the capillary tube 72 creates an approximately one minute time delay. A pressure switch PS on the holding tank 74 is set at 36 psi closed on rise, 8 psi open on fall. The volume of holding tank 74 depends upon the displacement volumes of the water tube 14 and nylon transport tube 62. The air valve 66 is operated by a solenoid 66' as hereinafter discussed with reference to FIG. 2.

The refrigeration circuit of FIG. 1 includes a motor compressor 78; a suction conduit 80 through which refrigerant gasses pass for compression; a discharge conduit 82 that conducts hot compressed gasses from compressor 78; a four-way reversing valve 84; a conduit 86 connecting the reversing valve 84 to a condensor 88; the condensor 88; a fluid line 90; a valve and tank network 91 on fluid line 90; a refrigerant evaporator tube 92; and, a conduit 94 connecting the evaporator tube 92 to the reversing valve 84. The fluid line 90, described in greater detail hereinafter, connects the condensor 88 to a first end of the evaporator tube 92. Thermostat means (such as a reverse action thermostat control bulb 96, also labeled "RAS") is located on conduit 94.

A portion 97 of evaporator tube 92 connected to restrictor 90 wraps in helical fashion around the circumference of a portion of the second water tube segment 54. In a preferred embodiment, thermal conduction delay means, such as a stainless steel cylindrical sleeve 96, is positioned between the second tube section 54 and the evaporator tube 92 helically wrapped therearound.

Evaporator tube 92 has a portion thereof (labeled 98) which encloses the helical portion of the water tube 14. In the embodiment shown in FIG. 1, evaporator tube portion 98 has a larger diameter than the tube 14 and is concentrically positioned around the tube 14 so that the portion 98 also assumes a helical shape as it encloses the tube 14. Evaporator tube portion 98 encloses tube 14 up to a point just short of the region 58 of tube 14 termination. At its extremities 100 (near the base of the helix) and 102 (near the region 58), the evaporator tube portion 98 is sealed about the tube 14.

Near its extremity 100 the evaporator tube portion 98 has a radial orifice 104 opening into an evaporator tube portion 106 which connects evaporator tube portions 98 and 97. Evaporator tube portion 106 is not in contact with the water tube 14.

The evaporator tube portion 106 has a radial orifice which allows communication of the tube portion 106 with a first end of a freezing cycle bypass tube 107 connected thereto. A second end of the freezing cycle bypass tube 107 connects to and communicates with an intermediate segment of portion 98 of the evaporator tube 92 through an orifice provided in tube 92. A conventional check valve 107CV is installed on freezing cycle bypass tube 107 to allow cold refrigerant to flow through tube 107 only in a direction from the first end of tube 107 toward the second end thereof during the freezing cycle. Check valve 107CV prevents flow of refrigerant from the second end to tube 107 to the first end thereof during a harvest cycle.

A radial orifice 108 near the extremity 102 of evaporator tube 92 facilitates the communication of evaporator tube portion 98 and the conduit 94. A harvest cycle bypass tube 109 has a first end connected to the conduit 94 (to allow communication of the bypass tube 109 with conduit 94 through a radial orifice in conduit 94) and a second end connected to and communicating with an intermediate segment of portion 98 of the evaporator tube 92 (through an orifice provided in tube 92). A conventional check valve 109CV is installed on the harvest cycle bypass tube 109 to allow hot refrigerant to flow through the tube 109 only in a direction from the first end of tube 109 toward the second end thereof during the harvest cycle. Check valve 109CV prevents flow of refrigerant from the second end of tube 109 to the first end thereof during a freezing cycle.

The reversing valve 84 comprises a sliding port main valve assembly connected by tubes 110 and 112 to a solenoid-actuated pilot valve (not shown). Although a reversing valve of this type has not hereto been used in an ice making machine, such valves are commercially available. The reversing valve 84 depicted in the embodiment of FIG. 1 and FIG. 1A is manufactured by Ranco, Inc. as model number Type V, the operation of which is described in Bulletin 1919-1 at page 2.

With further reference to the reversing valve 84, FIG. 1 illustrates the internal connections of valve 84 as it appears during a freezing cycle. In this respect, during the freezing cycle conduits 94 and 80 communicate with each other while conduits 82 and 86 communicate with each other. FIG. 1A, on the other hand, illustrates a harvest cycle wherein conduits 80 and 86 communicate with each other and conduits 82 and 94 communicate with each other.

The valve and tank network 91 which is located on fluid line 90 is shown in FIG. 1B. Network 91 comprises a freezing cycle expansion valve 114; a harvest cycle check valve 116; an in-line pressure actuated valve 118; a freezing cycle check valve 120; and, a refrigerant reservoir 122. In the embodiment illustrated in FIG. 1B, the expansion valve 114 is a 1.5 ton thermal-type expansion valve. Check valves 116 and 120 are conventional valves known in the refrigeration art. Valve 116 is connected on a fluid line 124 that bypasses in parallel fashion the expansion valve 114 (on line 90); the valve 120 is connected on a fluid line 126 that bypasses in parallel fashion the pressure valve 118 (on line 90). Valve 116 permits flow of refrigerant only in the direction of the arrow labeled HC in FIG. 1B (in the general direction from the evaporator tube 92 to the condenser 88), while valve 120 permits flow of refrigerant only in the opposite direction as noted by the arrow labeled FC in FIG. 1B.

The in-line pressure valve 118 is of a type that allows refrigerant to flow only in the direction of the arrow labeled HC (in the general direction from the evaporator tube 92 to the condenser 88), such flow being allowed only when pressure at a first end of the valve 118 (the first end being the end of valve 118 which faces expansion valve 114) exceeds the pressure at the second end of the valve 118 (the second end being the end of valve 118 which faces reservoir 122) by a predetermined differential that is dependent upon the pressure differential which exists across the reversing valve 84 when valve 84 reverses (as described hereinafter). In the preferred embodiment, which utilizes a spring-biased, pressure-actuated valve [part number ORD-4-20 manufactured by Sporlan] as the valve 118, a twenty pound (20 lb) psi differential must exist between the first end of valve 118 and the second end thereof for refrigerant to flow through the valve 118 in the direction specified above. The 20 lb psi differential across valve 118 occurs at a time when a substantially fifteen pound (15 lb) psi differential occurs across the reversing valve 84. For the valve 118 to open, the pressure differential across the valve 118 must be greater than the pressure differential across the reversing valve 84 upon reversal. Furthermore, for reasons seen hereinafter, the port openings for the valve 118 must be large enough to accommodate a sufficient flow of refrigerant therethrough in a relatively short period of time.

The refrigerant reservoir 122 is connected on line 90 intermediate the pressure valve 118 and the condensor 88. A segment 90A of fluid line 90 leads from the valve 118 and terminates at a relatively low level in the reservoir 122; a segment 90B of fluid line 90 leads from the condensor 88 and terminates at a level in the reservoir 122 which is relatively higher than the level at which segment 90A terminates. The reservoir 122 has approximately the same capacity as the capacity of the evaporation tube 92. For the embodiment shown in FIG. 1B, the reservoir 122 holds approximately 6 to 8 pounds of liquid refrigerant by weight.

The fluid line 90 which connects the condensor 88 to the evaporator tube 92 is, in the illustrated embodiment, a copper tube having an internal diameter (ID) of approximately one half inch and an outer diameter (OD) of approximately five-eights inch. An interface sleeve (not illustrated) is welded to connect and seal the fluid line 90 to the evaporator tube 92 in embodiments in which the evaporator tube 92 has greater internal and outer diameter dimensions than the fluid line 90.

Figure 2:
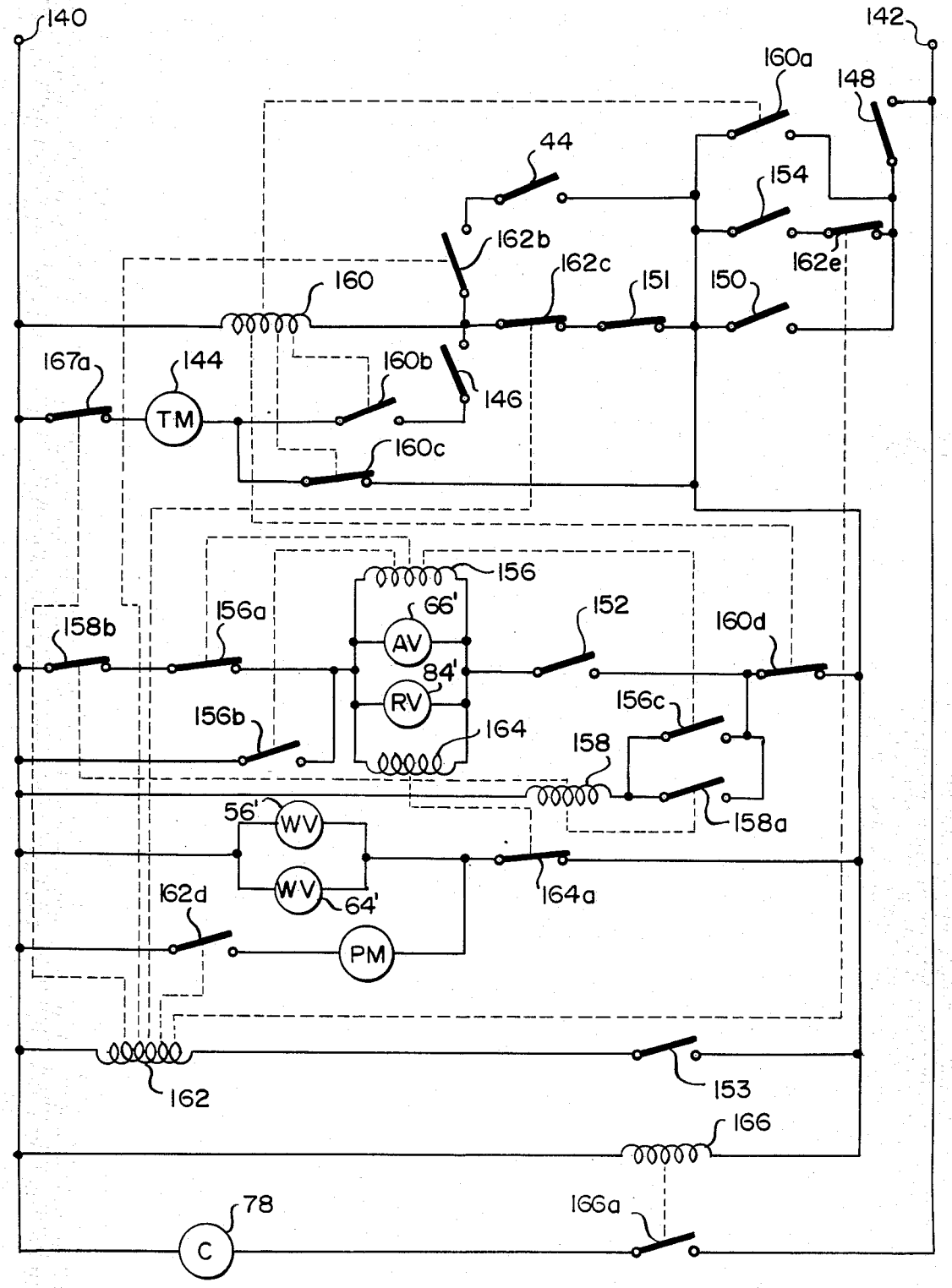

The electric circuit of FIG. 2 includes terminals 140 and 142 across which a 110-volt AC source is electrically connectable. Elements included in the circuit or FIG. 2 include the compressor 78; the pump motor PM; solenoids 56' and 64' operating water valves 56 and 64, respectively; solenoid 66' operating air valve 66; solenoid 84' operating reversing valve 84; a timer motor 144; a switch 146 controlled by the RAS thermostat 96; the microswitch 44; a master switch 148; a switch 150 controlled by a thermostat (not illustrated) which is located in an output bin (also not illustrated); a pressure switch 152 (responsive to switch PS on holding tank 74); a select switch 153; and, switches 154 and 151 associated with a microswitch.

Further included in the circuit of FIG. 2 are: relay coil 156 which controls relay contacts 156*a*, 156*b*, and 156*c*; relay coil 158 which controls relay contact switches 158*a* and 158*b*; relay coil 160 which controls relay contact switches 160*a*, 160*b*, 160*c*, and 160*d*; relay coil 162 which controls relay contact switches 162*a*, 162*b*, 162*c*, 162*d*, and 162*e*; coil 164 which controls relay contact switch 164*a*; and, relay coil 166, which controls relay contact switch 166*a*. The switches associated with the various coils in the circuit of FIG. 2 are illustrated in either an open or closed position depending on the behavior of each switch when its corresponding coil is not energized.

With respect with the operation of the ice making machine which has an embodiment thereof described above, two modes of operation are selectable: a "white" ice mode and a "hard" ice mode. The white ice mode, also known as the semi-hard mode or solid mode, is first described below.

OPERATION: WHITE ICE

In producing white ice, water is supplied through conduit 26 and float valve 28 into the first reservoir 18 until the water in reservoir 18 reaches the level 32 as determined by float 30. The water in reservoir 18 passes by gravity through the restrictor 48 in water pump 46, through conduit 12, and up to the water valve 56.

Electric power (110-volt AC) is connected across terminals 140 and 142 of the circuit of FIG. 2. Switch 153 is manually placed in an open position (to indicate the production of white ice) and bin thermostat switch 150 is closed in order to signal the need for the production of ice. Production commences upon the closure of master switch 148, the closure of which completes a circuit through switch 150, switch 151, switch 162*c*, and coil 160. Completion of this circuit energizes coil 160 and further completes both a circuit comprising switches 148, 150 and coil 166 (thereby energizing coil 166) and a circuit comprising switches 148, 150, 164*a* and coils 56' and 64' (thereby energizing coils 56' and 64').

Energizing coil 160 closes switch 160*a*, while energizing the coil 166 closes switch 166*a*. The closure of switch 166*a* starts the compressor motor 78. Energizing the water solenoid coils 56' and 64' open the respective water valves 56 and 64.

With the water valves 56 and 64 now open, water passes by gravity through water valve 56 into both segments 52 and 54 of water tube 14 wherein ice is to be formed. Water rises in the tube segment 52 to a level (E1) even with the water level 32 in reservoir 18.

As noted above, energizing coil 160 closes the switch 160*a* so that a lock out path parallel to the path of bin switch 150 is created and can remain closed even when bin switch 150 eventually opens.

At this point the solenoid coil 84' associated with the reversing valve 84 is not energized, so that the reversing valve is adapted for the freezing cycle as depicted in FIG. 1. With the compressor 78 operating and the tube 14 filled with water, refrigerant gasses are compressed by the compressor 78 and discharged through conduit 82 to the reversing valve 84 through which the hot compressed gasses are channelled to conduit 86. The hot compressed gasses pass from conduit 86 into the condensor 88 which cools the compressed gasses to liquid form.

The condensed refrigerant passes from the condensor 88 in the fluid line 90 and into the refrigerant reservoir 122. Condensed refrigerant in the reservoir 122—which includes not only the condensed refrigerant just added to the reservoir 122 from the condensor 88 but condensed refrigerant which had been driven through valves 118 and into the reservoir 122 during the previous harvest cycle—is forced from the reservoir 122 (by incoming refrigerant) into segment 90A of fluid line 90 towards the evaporator tube 92. That is, refrigerant is forced from reservoir 122 into fluid line 90, around bypass line 126 and through check valve 120, and through the expansion valve 114 on line 90 toward the evaporator tube 92. The storage of condensed refrigerant in the reservoir provides a quick source of refrigerant so that upon reversal of valve 84 from the harvest cycle to the freezing cycle the freezing cycle can begin much faster.

In travelling through the refrigerant evaporator tube 92, the cooled refrigerant first enters the tube portion 97 of the evaporator tube 92 so that it encircles the water tube segment 54 and then progressively travels to evaporator tube portion 106. At evaporator tube portion 106 the path of the cooled refrigerant forks so that refrigerant can take either two routes toward evaporator tube portion 98. The first route is through tube portion 106 and radial orifice 104 after which the cooled refrigerant travels substantially through the entire helix of tube portion 98. The second route is through the freezing cycle bypass tube 107 and through check valve 107CV which enables some of the cooled refrigerant to be introduced at an intermediate point of the evaporator tube portion 98 as depicted in FIG. 1.

Through the heat exchange of the water in the tube 14 and cold refrigerant and the evaporator tube 92, solid or "white" ice is formed in the tube 14. The refrigerant passes from the refrigerant evaporator tube 92 through its radial orifice 108 into the conduit 94 and back to the reversing valve 84.

In the above regard, the direction of travel of the refrigerant gas during the freezing cycle is depicted in FIG. 1 by arrows labeled "FC". During the freezing cycle the valve 84 connects conduit 94 to conduit 80 so that the returned refrigerant gas is applied to the intake side of the motor compressor 78.

During the freezing cycle, gas is metered through the capillary tube 72 into the holding tank 74, eventually raising the pressure to about 38 psi. The pressure switch PS on holding tank 74 functions to close the switch 152 when the pressure in the holding tank reaches 36 psi.

When ice is being formed in the tube 14 the temperature in the evaporator tube 92 decreases. When sensor means 96, including the capillary bulb installed on the suction conduit 94, senses a preset temperature, the switch 146 closes. Closure of switch 146 establishes a circuit to activate the timer motor 144. The circuit activating timer motor 144 includes closed contacts 162*a*, 160*b*, 146, 162*c*, 151, 150, and 148. In this respect, even when switch 150 eventually opens, the timer-motor 144 may remain actuated by virtue of closed switch 160*a* as described above.

When the timer motor 144 is activated, a cam in the timer eventually advances to a point at which an actuator arm of a timer microswitch (not illustrated) drops into a cam slot (also not illustrated), thereby opening switch 151 and closing switch 154. Opening switch 151 de-energizes coil 160, thereby opening switches 160*a* and 160*b* while closing switches 160*c* and 160*d*. Timer motor 144 continues to operate through a closed circuit including switches 162*a*, 160*c*, 154, 162*e*, and 148.

Closing the switch 160*d* energizes coils 156, 164, 84' (connected to the reversing valve 84), and 66' (connected to the air valve 66). Energizing coil 156 closes switch 156*c* which completes a circuit including switches 156*c* and 160*d* to energize coil 158. Energizing coil 164 opens switch 164*a*, thereby deenergizing the solenoid 56' and 64' associated with water valves 56 and 64, respectfully.

Upon energizing the reversing valve 84, the valve 84 assumes the internal configuration depicted in FIG. 1A for the harvest cycle. That is, hot compressed gas leaving the compressor 78 through discharge conduit 82 is channeled by the valve 84 to the conduit 94, from whence it is applied to the refrigerant evaporator tube 92 at the radial orifice 108 and through harvest cycle bypyass tube 109. The hot refrigerant travels downwardly through the evaporator tube portion 98 in helical fashion, exits from tube portion 98 through the radial orifice 104; enters the evaporator tube portion 106; and, continues into evaporator tube portion 97 where it encircles the water tube segment 54.

The gas refrigerant travels from the evaporator tube portion 97 into the fluid line 90 valve and tank network 91 located thereon, driving before it condensed or cooled liquid refrigerant that was used during the freezing cycle. In this respect, the condensed refrigerant is forced into line 90, around bypass line 124 and through check valve 116 and towards the in-line pressure valve 118 on line 90. When the pressure differential on the first end of valve 118 (the end facing expansion valve 114) exceeds the pressure at the second end thereof (the end facing the reservoir 122) by a pre-determined differential, the pressure valve opens to allow condensed liquid refrigerant to pass quickly through the valve 118 and into the reservoir 122. In the embodiment described, the pressure differential is 20 psi. The condensed liquid refrigerant is then temporarily stored in the reservoir 122 for ready use when the reversing valve 84 switches from the harvest cycle to another freezing cycle.

It should be understood that in an alternate embodiment wherein the reservoir 122 is not utilized, that gas used during the harvest cycle would pass to the condensor 88 which then functions as an evaporator. From the condensor 88 the gas is applied through conduit 86 to the four-way reversing valve 84 which, as seen in FIG. 1A, directs the gas into intake conduit 80 the compressor 78. As indicated in FIG. 1, the direction of travel of the hot refrigerant gas during the harvest cycle is shown by arrows labeled "HC".

Application of the hot refrigerant gas through the refrigerant tube 92 during the harvest cycle permits thawing of ice on the inner wall of the water tube 14 to sufficiently loosen and free the ice from the inner surface of the tube 14. Since the hot refrigerant is applied in the direction HC, thawing commences at the extremity 102 of the evaporator tube portion 98 continues towards extremity 100. Lastly, the hot refrigerant is applied to evaporator tube portion 97 which encircles the second tube segment 54. A greater degree of thawing occurs near the extremity 102 of evaporator tube portion 98 than in the water tube segment 54 which is encircled by evaporator tube portion 97. In this respect, the travel time required by the hot refrigerant to circulate downwardly through the helical evaporator tube portion 98 delays and decreases the heat exchange between the hot refrigerant and a solid ice plug formed in the water tube segment 54. Further, heat exchange between the hot refrigerant in evaporator tube portion 97 and the ice in water tube segment 54 is delayed by sleeve 96 as described above.

The thawing operation loosens ice formed in the water tube 14 by melting the ice at its point of contact with the inner wall of the tube 14. Thus, an annular gap is formed between the ice and tube 14. Since during the harvest cycle less heat exchange occurs with respect to the solid plug formed in the water tube segment 54, upon thawing the annular gap is the smallest in water tube segment 54. Hence, when the air valve 66 is opened by energizing the coil 66' associated therewith during the harvest cycle as described above, the pressurized gas is applied to the solid plug formed in water tube segment 54. When the solid plug formed in water tube segment 54 is sufficiently loosened from the segment 54, the pressurized gas drives the solid plug from the tube segment 54, through the helical tube segment 52, and discharges the solid plug from the tube 14 near the coupling 60 into the nylon tubing 62 wherein the plug travels to the receptical bin (not illustrated). The discharge velocity of the ice is selectively controllable by adjusting the pressure in capillary tube 76.

As the solid ice plug is driven through the tube 14 in the above-described manner, the solid plug drives before it the loosened ice formed in the first tube segment 98. The ice formed in tube segment 98 is broken into pellets as it travels through and is discharged from the helical configuration of the tube segment 98. Since the solid plug of ice travels through the tube 14 with the least clearance, there is no significant pressure leak resulting from the loosening of the solid ice plug.

Utilization of the reversing valve 84 in the above described manner initiates the thawing operation of the harvest cycle essentially immediately upon completion of the freezing cycle. In this respect, unlike prior art ice making machines, there is no delay in waiting for the compressor 78 to compress hot refrigerant and apply the same for melting the ice. Instead, the hot refrigerant discharged from the compressor 82 is essentially immediately re-routed to the evaporation tube through the action of reversing valve 84 upon the energizing of solenoid 84' at the beginning of the harvest cycle. Utilization of the inline pressure valve 118 and the refrigerant reservoir 122 further permits the condensed liquid which was in the evaporator tube 92 to be quickly emptied therefrom by hot refrigerant gas which enters the evaporator tube 92 when the reversing valve switches from a freezing cycle to a harvest cycle.

Whereas in prior art ice making machines a delay on the order of 30 seconds was required to make the transition from the freezing cycle to the harvest cycle, the transition is accomplished essentially immediately utilizing the reversing valve 84, the pressure valve 118, and the reservoir 122. In addition, as described below, reversing valve 84 advantageously changes the direction of the refrigerant flow in order to control the timing of the heat exchange between the hot refrigerant and the ice formed in various portions of the water tube 14.

Upon discharge of the ice through the nylon tubing 62 into the receiving bin, if the receiving bin is full the sensor means in the bin opens the switch 150 to de-energize the coil 160, thus ceasing the operation of the system. However, if the sensor means in the receiving bin indicates that additional ice pellets should be produced, the sensor means continues to keep the bin switch 150 closed so that the freezing cycle will start again.

It will be recalled that during the freezing cycle gas was metered through the capillary tube 72 into the holding tank 74. The pressure switch PS on holding tank 74 functioned to close the switch 152 when the pressure in the holding tank reached 36 psi. Upon discharge of ice, pressure is reduced in holding tank 74 through capillary tube 76 faster than it is metered into capillary tube 72. Accordingly, the pressure in holding tank 74 drops so that the pressure switch PS functions to open switch 152, thereby de-energizing relay solenoid coils 156, 164, 84' (associated with the reversing valve 84), and 66' (associated with air valve 66). De-energization of coil 164 closes switch **164*a* to energize the solenoid coil 56' and 64' to open the water valves 56 and 64. When the solenoid 84' associated with reversing valve 84 is de-energized, the freezing cycle commenses since the reversing valve 84 assumes the internal configuration of FIG. 1 rather than of FIG. 1A. De-energizing coil 66' closes the air valve 66** associated therewith.

OPERATION: CLEAR ICE

In a second mode of operating the ice making machine of FIG. 1, "clear" ice, also known as "hard" ice or "hollow" ice, is produced. To initiate production of clear ice, water is introduced through the water supply conduit 26 into the reservoir 18. Water continues to flow through the conduit 26 until the water in reservoir 18 reaches the level 32, at which point float 30 operates to shut the valve 28. At this point bin switch 150 is closed to indicate that the ice receiving bin (not illustrated) is not full and that the production of ice is required. The master switch 148 is manually closed to indicate commencement of ice production and switch 153 is manually closed indicate that clear ice is to be produced.

Upon the closure of master switch 148, a circuit including switches 148, 150, and 153 is closed to energize coil 162. Energizing coil 162 opens switch **162*c* to break the circuit to switch 151. Further, energizing coil 162 closes switch 162*d* to start the pump motor PM. In addition, energizing coil 162 opens switch 162*a* to break the circuit to the timer motor 144. Further, solenoids 56' and 64', associated with water valves 56 and 64, respectively, are energized to open the water valves 56 and 64. Closing of switch 160*a* also energized the coil 166, which in turn closed the switch 166*a* to start the compressor 78**.

As a result of the above operations, the ice making machine is now in the freezing cycle (FC). During the clear ice making mode, refrigeration circuit of the FIG. 1 embodiment functions substantially similarly as it did during the white-making mode described above. However, in the water circuit the pump motor (PM) operates pump 46 to impell water through the restrictor 48 and into the conduit 12. Since water valves 56 and 64 have been open through action of the associated water valve solenoid 56' and 64' respectively, water enters the tube 14 at a point 50 intermediate the first tube segment 52 and the second tube segment 54.

In entering the tube 14 at point 50 the water essentially fills the second tube segment 54 and circulates upwardly to the helical path of the first tube segment 52. The pump 46 pumps the water completely through the tube segment 52, even to the tube termination region 58. Since the water valve 64 is open, water passes from the tube 14 into the conduit 16 and empties into the second or upper reservoir 20. The water emptying into the water reservoir 20 lifts the float 36 so that the central appendage 42 thereof is not in contact with the microswitch 44. Breaking the connection with the microswitch 44 and the central appendage 42 functions to close the switch 44, thereby energizing coil 160.

Water gradually bleeds from the upper reservoir 20 into the lower reservoir 18 through the restrictor 24. In this respect, the degree of restriction provided by restrictor 24 is variable so that the flow of water emptying into the water reservoir 20 lifts the float 36 so that the central appendage 42 thereof is not in contact with the microswitch 44. Breaking the connection with the microswitch 44 and the central appendage 42 functions to close the switch 44, thereby energizing coil 160.

Water gradually bleeds from the upper reservoir 20 into the lower reservoir 18 through the restrictor 24. In this respect, the degree of restriction provided by restrictor 24 is variable so that the flow of water may be varied accordingly, and hence the diameter of the hollow cavity of the ice produced in tube segment 52. Should the upper reservoir 20 reach capacity, water contained in the reservoir 20 passes over overflow dam 22 into the lower reservoir 18. Water in the lower reservoir 18 in excess of the water level 32 leaves the system through the overflow pipe 34.

The pump 46 circulates water through the water circuit while heat exchange occurs between the water in the water circuit and the cold refrigerant traveling in the direction FC to form ice on the interior wall of the water tube segment 52. As the deposit of ice on the interior wall of the water tube segment 52 increases, the flow of water being circulated through the water circuit becomes restricted.

Eventually restriction of the water flow of the water circuit eliminates any overflow at the overflow dam 22, although water continues to be bleed through the restrictor 24 into the lower reservoir 18. Eventually ice is sufficiently formed on the interior wall of the first tube segment 52 that the flow of water through conduit 16 and to upper reservoir 20 becomes so restricted that the float 36 begins to drop. In this respect, the flow through restrictor 24 exceeds the flow into the reservoir 20 through the conduit 16. When ice is sufficiently formed in the tube segment 52, the float 36 drops to its lowest point of vertical travel such that the central appendage 42 therein again contacts the microswitch 44.

When the central appendage 42 contacts the microswitch 44, switch 44 of the circuit of FIG. 2 opens thereby initiating the harvest cycle. In particular, opening switch 44 de-energizes coil 160. De-energizing coil 160 closes switch **160*d* which, since the switch 152 is closed during refrigeration cycle (much in the same manner as in deduction of white ice), completes the circuit to the following coils: coil 84' (thereby switching the reversing valve 84 into the configuration of FIG. 1A for the harvest cycle); coil 66' (thereby opening the air valve 66 to apply pressurized gas to the tube 14); coil 164 (which opens switch 164*a*, thereby turning off the pump motor PM and de-energizing the coils 56' and 64' to shut off the water valve 56 and 64, respectively); and, coil 156**.

With the ice machine now operating in the harvest cycle for the clear ice mode, the hot refrigerant travels in the path indicated by arrows labeled "HC". The discharge of the clear, hollow ice from the water tube segment 52 essentially resembles the discharge of ice in the white ice mode discussed above. It is to be noted, however, that even during the clear ice mode a solid plug of ice is formed in the second tube segment 54, and that the solid plug in tube segment 54 serves to drive the hollow ice from the tube segment 52. Absent the presence of the solid plug in the tube segment 54, the pressurized gas would leak through the hollow center of the clear ice formed in the tube segment 52. The ice discharging procedure of the clear ice mode essentially resembles that of the white ice mode, including the utilization of the pressure switch PS to open the switch 152.

From the foregoing description of structure and operation it can be seen that the ice making machine of the invention advantageously produces either white or clear ice, as desired. Further, the ice production is efficient and economical in that the transition from a freezing cycle to a harvest cycle occurs essentially immediately by virtue of employment of the reversing valve 84. Moreover, the ice produced by the ice making machine is transported quickly over long distances using the motive force of pressurized gas. The utilization of the reversing valve 84 makes discharge of the ice using a pressurized gas feasible in that the reverse direction of the application of hot refrigerant minimumizes gas leak at the point of application of the motive pressurized gas.

While the invention has been particularly shown and described with reference to the preferred embodiments thereof, it will be understood by those skilled in the art that various alterations in form and detail may be made therein without departing from the spirit and scope of the invention. For example, the water valve 56 can be a water-type check valve rather than a solenoid valve as shown.

The embodiments of the invention in which an exclusive property or privilege is claimed are defined as follows:

1. An ice making machine including:

means defining a water circuit, said water circuit including a tube wherein ice is formed;

means for introducing water into said water circuit;

means defining a refrigeration circuit, at least a portion of said refrigeration circuit disposed in heat exchange relationship about at least a portion of said tube;

means for circulating a refrigerant through said refrigerant circuit, wherein in a freezing cycle said refrigerant circulation means is adapted to circulate cold refrigerant in a first direction through said refrigerant circuit, whereby heat exchange between water in said tube and said refrigerant causes the formation of a deposit of ice on an inner wall of said tube, said first direction being from a first end of said tube to a discharge end thereof, wherein in a harvest cycle said refrigerant circulation means is further adapted to circulate hot refrigerant in a second direction through said refrigerant circuit, whereby the outer periphery of ice formed in said tube is sufficiently thawed and loosened to facilitate the discharge of ice from said tube, wherein said first direction is opposite said second direction, said means for circulating said refrigerant through said refrigerant circuit comprising a four-way valve having a first port connected to a condensor included in said refrigerant circuit, a second port connected to a first port of a refrigerant compressor, a third port connected to a second port of a refrigerant compressor, and a fourth port connected to a portion of said refrigerant circuit which is in heat exchange relation with said water circuit, said first port of said four-way valve being selectively communicable with said second and third ports thereof, said second port of said four-way valve being selectively communicable with said first and fourth ports thereof, and said third port of said four-way valve being selectively communicable with said first and fourth ports thereof;

a one-directional pressure valve and a refrigerant reservoir connected between said condensor and said portion of said refrigerant circuit which is in heat exchange relation with said water circuit, said one-directional pressure valve being adapted to permit refrigerant to flow therethrough and into said refrigerant reservoir when a sufficiently high pressure differential exists across said one-directional pressure valve, said refrigerant reservoir being connected to said condensor;

sensor means for determining when ice is sufficiently formed in said tube;

means for initiating said harvest cycle; and, means for discharging ice from said tube.

2. The ice making machine of claim 1 further comprising valve means responsive to said sensor means for selectively controlling the communication of said source of pressurized gas with said tube.

3. The ice making machine of claim 1 further comprising means for selectively varying the degree of pressurization of said gas and hence the discharge velocity of said ice from said tube.

4. The ice making machine of claim 1, wherein said four-way valve is a solenoid actuated valve responsive to temperature sensitive means in said water circuit.

5. The ice making machine of claim 1, wherein said pressure differential across said one-directional pressure valve which allows refrigerant to flow therethrough has a pre-determined relationship to a pressure differential that exists across said four-way valve when said four-way valve switches from a freezing cycle to a harvest cycle.

6. A method of making ice comprising the steps of:

introducing water into a water circuit, said water circuit including a tube wherein ice is formed;

in a freezing cycle circulating a cold refrigerant through said refrigeration circuit in a first direction from a first end of said tube to a discharge end thereof whereby heat exchange between water in said tube causes the formation of a deposit of ice on an inner wall of said tube;

determining when ice is sufficiently formed in said tube;

in a harvest cycle circulating a hot refrigerant through said refrigeration circuit in a second direction opposite said first direction so that the outer periphery of ice formed in said tube is sufficiently thawed and loosened so that said ice may be discharged from said tube; and, selectively applying a source of pressurized gas to said tube proximate said first end thereof for pneumatically discharging said loosened ice through and from said tube.

7. The ice making method of claim 6, further comprising the steps of:

using a mode select means for selecting whether solid ice is to be formed in accordance with a first mode or hollow ice is to be formed in accordance with a second mode;

retaining water in said water circuit in a substantially non-circulating manner when said first mode is selected;

circulating water through said water circuit when said second mode is selected, said circulation being facilitated by pump means responsive to said mode select means;

terminating the circulation of water through said water circuit when said second mode is selected and when it has been determined that ice is sufficiently formed in said tube.

8. The ice making method of claim 7 further comprising the step of introducing water into said tube at a point intermediate a first segment and a second segment of said tube, said first tube segment being so positioned that water circulates therethrough when a pump means is operating to form hollow ice in said first tube segment, said second tube segment being so positioned that water is introduced therein but not circulated therethrough when said pump means is operating so that at least a plug of solid ice is formed in said second tube segment.

9. The ice making method of claim 8 further comprising the step of using valve means to control the introduction of water into said tube at said intermediate point.

10. The ice making method of claim 9 further comprising the step of slowing during said thawing operation the heat exchange between said refrigerant in said refrigerant circuit and said water in said second tube segment.

11. The ice making method of claim 8 wherein said step of discharging ice from said tube comprises selectively applying a source of pressurized gas into said second tube segment for pneumatically driving said plug of solid ice formed therein from said second tube segment and through said first tube segment in such a manner that said plug of solid ice causes ice formed in said first tube segment to be discharged from said tube.

12. The ice making method of claim 11 further comprising the step of selectively controlling in response to said sensor means the communication of said source of pressurized gas with said tube.

13. The ice making method of claim 11 further comprising the step of selectively varying the degree of pressurization of said gas and hence the discharge velocity of said ice from said tube.

14. The ice making method of claim 6, further comprising the step of selectively controlling in response to said sensor means the communication of said source of pressurized gas with said tube.

15. The ice making method of claim 6, further comprising the step of selectively varying the degree of pressurization of said gas and hence the discharge velocity of said ice from said tube.

16. An ice making machine including means defining a water circuit, said water circuit including a tube wherein ice is formed;

means for introducing water into said water circuit;

means defining a refrigeration circuit, at least a portion of said refrigeration circuit disposed in heat exchange relationship about at least a portion of said tube;

means for circulating a refrigerant through said refrigerant circuit wherein in a freezing cycle said refrigerant circulation means is adapted to circulate cold refrigerant in a first direction through said refrigerant circuit, whereby heat exchange between water in said tube and said refrigerant causes the formation of a deposit of ice on an inner wall of said tube, said first direction being from a first end of said tube to a discharge end thereof, wherein in a harvest cycle said refrigerant circulation means is further adapted to circulate hot refrigerant in a second direction through said refrigerant circuit, whereby the outer periphery of ice formed in said tube is sufficiently thawed and loosened to facilitate the discharge of ice from said tube, wherein said first direction is opposite said second direction;

sensor means for determining when ice is sufficiently formed in said tube;

means responsive to said sensor means for initiating a harvest cycle; and, means for discharging ice from said tube, said discharge means including a source of pressurized gas in selective communication with said tube proximate said first end thereof for pneumatically driving said loosened ice through and from said tube.

17. The ice making machine of claim 16 further comprising:

mode select means for selecting whether solid ice is to be formed in accordance with a first mode or hollow ice is to be formed in accordance with a second mode;

valve means for selectively communicating said tube with the remainder of said water circuit so that said water in said tube may be selectively circulated with respect to the remainder of said water circuit; and, pump means responsive to said mode select means, said pump means being unactivated when said first mode is selected so that water introduced into said water circuit is substantially non-circulating for the production of solid ice when said refrigerant is circulated through said refrigerant circuit, said pump means being activated when said second mode is selected so that water introduced into said water circuit is circulated for the production of hollow ice when said refrigerant is circulated through said refrigerant circuit, said pump means further being responsive to said sensor means for terminating the circulation of water through said water circuit once hollow ice is sufficiently formed in accordance with said second mode.

18. The ice making machine of claim 17 wherein water is selectively introduced into said tube at a point intermediate a first segment and a second segment of said tube, said first tube segment being so positioned what water circulates therethrough when said pump means is operating to form hollow ice in said first tube segment, said second tube segment being so positioned that water is introduced therein but not circulated therethrough when said pump means is operating so that at least a plug of solid ice is formed in said second tube segment.

19. The ice making machine of claim 18 wherein said valve means controls the introduction of water into said tube at said intermediate point.

20. The ice making machine of claim 19 further comprising thermal conduction delay means for slowing the heat exchange between said refrigerant in said refrigerant circuit and said second tube segment.

21. The ice making machine of claim 20 wherein said conduction delay means includes a sleeve member positioned intermediate said second tube segment and said portion of said means defining said refrigerant circuit disposed thereabout.

22. The ice making machine of claim 18, wherein said means for discharging ice from said tube comprises a source of pressurized gas in selective communication with said second tube segment for pneumatically driving said plug of solid ice formed therein from said second tube segment and through said first tube segment in such a manner that said plug of solid ice causes ice formed in said first tube segment to be discharged from said tube.

23. The ice making machine of claim 22, further comprising valve means responsive to said sensor means for selectively controlling the communication of said source of pressurized gas with said tube.

24. The ice making machine of claim 22, further comprising means for selectively varying the degree of pressurization of said gas and hence the discharge velocity of said ice from said tube.

* * * * *